US007187625B2

(12) United States Patent
Riggi

(10) Patent No.: US 7,187,625 B2
(45) Date of Patent: Mar. 6, 2007

(54) SHOFAR TIMEKEEPING APPARATUS AND METHOD

(76) Inventor: Scott S. Riggi, 2039 Euclid Ave., Schenectady, NY (US) 12306

( * ) Notice: Subject to any disclaimer, the term of this patent is extended or adjusted under 35 U.S.C. 154(b) by 7 days.

(21) Appl. No.: 11/161,222

(22) Filed: Jul. 27, 2005

(65) Prior Publication Data

US 2005/0237860 A1 Oct. 27, 2005

(51) Int. Cl.

| | |
|---|---|
| ***G04B 21/02*** | (2006.01) |
| ***G04B 23/02*** | (2006.01) |
| ***G04B 19/00*** | (2006.01) |
| ***G04C 21/16*** | (2006.01) |

(52) U.S. Cl. ..... 368/73; 368/75; 368/251; 368/272; 368/274

(58) Field of Classification Search ..... 368/72–75, 368/243–246, 250–251, 272–274
See application file for complete search history.

(56) References Cited

U.S. PATENT DOCUMENTS

| | | | | |
|---|---|---|---|---|
| 3,376,700 | A | 4/1968 | Davis et al. | 368/274 |
| 3,835,640 | A | 9/1974 | Hughes, Jr. | 368/63 |
| 4,098,068 | A * | 7/1978 | Masuyama | 368/272 |
| 4,488,820 | A * | 12/1984 | Takebe | 368/273 |
| 4,531,841 | A | 7/1985 | Puff | 368/63 |
| 4,730,284 | A | 3/1988 | Adams | 368/72 |
| 4,771,410 | A | 9/1988 | Kolibaba et al. | 368/73 |
| 5,226,021 | A | 7/1993 | Dell'Olio | 368/12 |
| 5,311,488 | A | 5/1994 | Trantham | 368/250 |
| 5,452,270 | A | 9/1995 | Ikeda et al. | 368/273 |
| 5,506,819 | A | 4/1996 | Chen | 368/75 |
| 5,519,672 | A | 5/1996 | Zwolinski | 368/10 |
| D378,277 | S | 3/1997 | Napolitan et al. | D10/6 |
| 6,009,048 | A | 12/1999 | Raesz | 368/10 |
| D441,300 | S | 5/2001 | Chiang | D10/6 |
| D442,871 | S | 5/2001 | Moore | D10/8 |
| 6,507,538 | B2 * | 1/2003 | Articola | 368/263 |
| 6,657,923 | B2 | 12/2003 | Laughlin | 368/10 |
| 2003/0035346 | A1 | 2/2003 | Laughlin | 368/250 |

* cited by examiner

*Primary Examiner*—Vit W. Miska
(74) *Attorney, Agent, or Firm*—Jay R. Yablon

(57) ABSTRACT

Disclosed herein is an apparatus and method for audibly playing through a speaker (12) of a timekeeping apparatus (1) comprising a visual replica of a shofar (11), at least one shofar call sound (14) in response to a timing device (17) of said timekeeping apparatus (1) reaching a predetermined time.

44 Claims, 1 Drawing Sheet

SHOFAR TIMEKEEPING APPARATUS AND METHOD

BACKGROUND OF THE INVENTION

This invention relates to timekeeping devices which make sounds at various times to alert the user to the time, and methods of rendering time-based alarms and sounds, and particularly to a timekeeping apparatus which merges the visual and auditory experience of seeing and hearing the Jewish shofar with the timekeeping apparatus.

BACKGROUND OF THE INVENTION

Alarm clocks and related timekeeping devices are widely used to ensure that a person is awakened at a particular time, or is alerted that a particular time has arrived. Many alarm clocks are noisy and abrupt and startle the user, while others such as clock radios wake the user to the more soothing sounds of music.

Within the crowded prior art area pertaining to alarm clocks, there are numerous alarm clocks which combine visual and auditory experience. These clocks have a visual element through which (or near which) the alarm sound is rendered, and the sound itself bears a close nexus to the visual element.

Thus, for example, U.S. Pat. No. 3,835,640 displays a cartoon character and renders and alarm in a voice that the hearer would recognize to be that of the associated character. In U.S. Pat. No. 4,531,841, the illustrated character is the well-known "Mickey Mouse." U.S. Pat. No. 4,730,284 employs an "animal standing atop a base," and the animal illustrated is that of a rooster. The alarm sound from this would be the familiar "cock-a-doodle-doo" sound that a rooster makes at daybreak to awake those residing on a farm, and it is pointed out that other animal, such as elephants and crickets, might also be considered. (See generally, column 1, line 41 through column 2, line 7.) U.S. Pat. No. D442,871 is for a talking cowboy.

Other patents disclose, not a character and an associated voice, but a particular musical instrument and the music that such an instrument would make. Thus, for example, U.S. Pat. No. 4,771,410 illustrates an alarm clock where the visual element is a bugle, and the associated alarm sound is that of the musical score "Reveille" which is sounded by a bugle to awaken military personnel. So too, U.S. Pat. No. D441,300 shows what appears to be a trumpet.

Other patents disclose a visual element comprising certain non-musical objects, in association with the sound made by those objects. A train passing in the night is a primordial sort of sound, and U.S. Pat. Nos. 5,226,021; 5,311,488; and 5,506,819 all disclose a visual element comprising a model train, and the alarm sounds, of course, replicate those made by a passing train, complete with (for U.S. Pat. No. 5,226,021) smoke/steam to add to the visual experience. In the same vein, U.S. Pat. No. 5,519,672; and U.S. Pat. No. D378,277 disclose a visual element which is a fishing reel, with an alarm sound that simulates the sound of a fishing reel being wound to pull in a fish. And for casino-goers, U.S. Pat. Nos. 6,009,048; 6,657,923; and 2003/0035346 comprise a slot machine, with the associated sound being that of the bells and whistles that one hears when one has "hit the jackpot."

Other patents of background interest which employ a pre-recorded alarm include U.S. Pat. No. 3,376,700; U.S. Pat. No. 5,452,270 which plays several musical melodies.

Despite the wide variety of alarm clocks known in the art which associate the visual with the auditory, these does not appear to be any sort of clock which creates for the user the religious experience of seeing and hearing the sound blasts ("shofar calls") of the Jewish shofar.

According to http://www.s-hamilton.k12.ia.us/antiqua/shofar.htm: "Of martial origin, the shofar was a priestly instrument in Biblical times . . . . Apart from its liturgical uses the shofar was closely connected with magical symbolism. Its blast destroyed the walls of Jericho, and in the Dead Sea scrolls we read that during battles shofar blowers sounded a powerful war cry to instill fear into the hearts of the enemy while priests blew the six trumpets of killing. Historically the shofar has also served in a number of popular usages: it was sounded during rites to bring rain, in the event of local disasters, and so on. In our times its liturgical use is restricted to New Year (Rosh Hashanah) and the Day of Atonement (Yom Kippur)." To those of Jewish faith, these are the holiest times of the year.

The shofar is customarily fabricated from the horn of a ram, to signify the ram that God gave to Abraham for sacrifice in place of Isaac.

The shofar, as it is sounded, defines a peak moment of religious experience, and is a call to its hearers to awaken to the voice of God. It cuts through the day to day events of life and is call to and a reminder of the divine. Thus, a shofar, simulated in the form of an alarm clock or related timekeeping apparatus, reminds the user each time the device sounds to awaken to God. Other messages have also been associated with the shofar include: revelation, redemption, freedom, rest. repentance, creation, giving of the Torah, the words of the prophets, destruction of the Temple, the binding of Isaac, fear of God, day of judgment, the promised land of Israel, and resurrection.

These are messages and feelings which are not communicated by any of the prior art, which merely entertains the user with a cartoon character, jolts the user with the military discipline of the Reveille call, sounds a train whistle, causes the user to think about going fishing, or summons the user to the gambling casino.

At http://jubileeinstruments.messianic-webhosting.com/shofar.htm, it is stated that "the Shofar has four basic calls that have been handed down throughout the ages. These terms can be found in the scriptures at various points. The sequence we know today has been handed down as a tradition. There where probably other calls as well, but they have apparently become lost. The names of the calls and description are as follows:

Tekiah—A Single medium length blast. Low-to-high pitch transition. Hard short push on low pitch, slight sustain on high pitch sometimes ended with a short pushing higher pitch burst.

Shevarim—Three blasts each low-to-high pitch sounded like triplets, think of Shevarim as being three short Tekiahs without the short burst on the ends.

Teruah—Teruah consists of rapid single second pitch bursts in a staccato fashion. There should be nine or more bursts for make a Teruah.

Tekiah G'dollah—Similar to Tekiah, only the high note is sustained for the longest possible breath. Also ended with a violent short pushed out breath of an even higher pitched note."

Also sounded is a sequenced combination of Tekiah, Shevarim, Teruah, ending with a Tekiah G'dollah, see and http://www.piney.com/Shofar.html.

At the end of the Jewish holiday of Yom Kippur, the following sequence is often used. First, three repetitions of Tekiah, Shevarim, Teruah, Tekiah. Next, three repetitions of Tekiah, Shevarim, Tekiah. Then, three repetitions of Tekiah Teruah, Tekiah. Sometimes, the number of the repetitions may be varied. Tekiah G'dollah is often a final blast at the end of a shofar call.

It would be desirable to provide a more inspirational sort of timekeeping device, system and method which calls the user away from mundane and material pursuits like fishing and gambling and waking to drills in military boot camp, toward the voice of God.

SUMMARY OF THE INVENTION

Disclosed herein is an apparatus and method for audibly playing through a speaker 12 of a timekeeping apparatus 1 comprising a visual replica of a shofar 11, at least one shofar call sound 14 in response to a timing device 17 of said timekeeping apparatus 1 reaching a predetermined time.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing in which:

DETAILED DESCRIPTION

Figure 1:
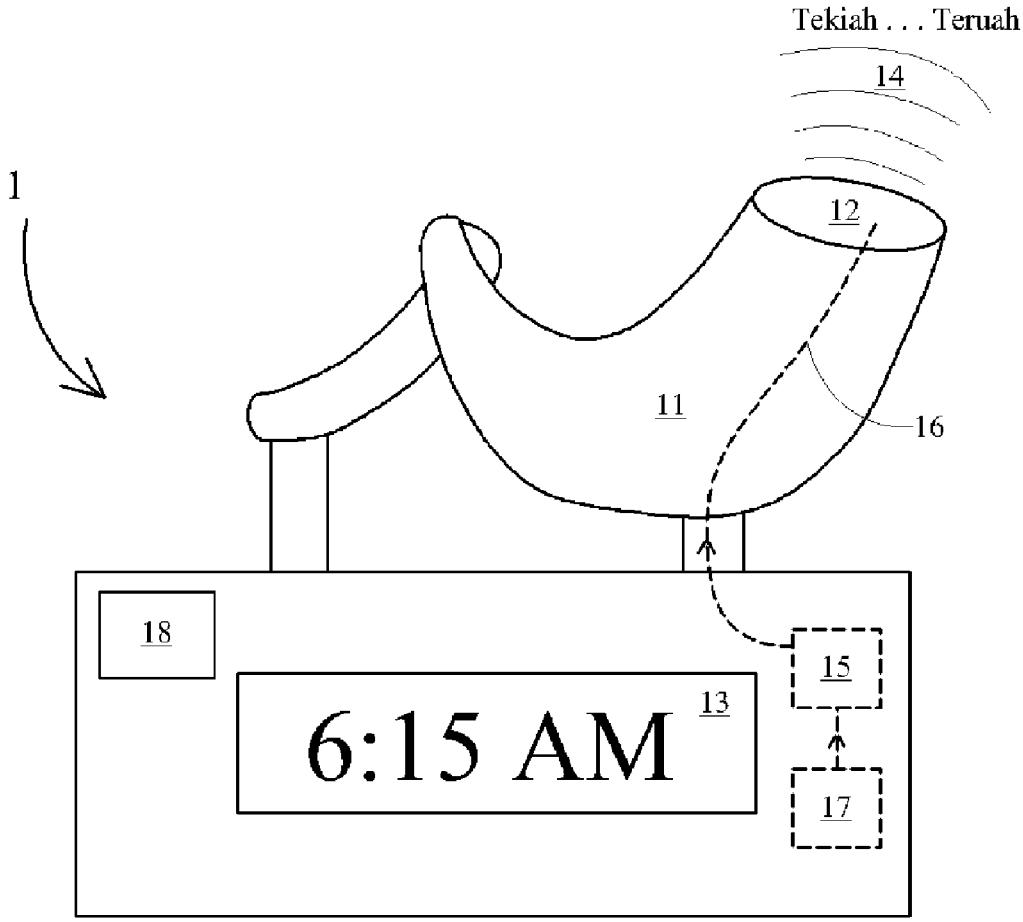
FIG. 1 illustrates a shofar-sounding timekeeping apparatus in accordance with an embodiment of the invention.

FIG. 1 illustrates a shofar alarm clock 1 in accordance with a primary embodiment of the invention. Shofar alarm clock 1 comprises a visual replica of a shofar 11, including an output mouth thereof which is the wide end of the shofar through which sound ordinarily emerges.

A shofar sound medium 15 contains a representation at least one audible sound 14 simulating a shofar call ordinarily made when using a shofar, such as for Jewish religious observance. Shofar sound medium 15 many employ any one of a number of techniques widely known in the art for storing and creating sound. For example, shofar sound medium 15 may comprise a recording apparatus with said at least one audible shofar call recorded thereon. This recording apparatus, for example, may be in the form of magnetic tape, or a computer memory chip, or an optical storage device, or any other device known or which may become known in the art for storing sounds for later playback. Digital audio files, such as, but not limited to wav and midi and real and mp and Quicktime and Macromedia and similar files are all suitable recordings for this purpose. Alternatively, shofar sound medium 15 may comprise a sound synthesizing apparatus synthesizing said at least one audible shofar call. Sound synthesizers typically employ computer data which in some manner represents a sound or sounds to be made. A computer processor then interprets this computer data, and causes the desired sound to be made. In short, shofar sound medium 15 may comprise and utilize any number of the diverse means and method available in the art or which may become available in the art in the future for in some fashion representing a sound, such that the desired sound can subsequently be made from that stored representation.

Preferably, for optimum realistic effect, the output mouth of shofar replica 11 comprises a speaker 12 for audibly playing said at least one audible shofar call sound 14 representation comprised within said shofar sound medium 15. In particular, when a timing device 17 reaches a predetermined time (such as, for example only, 6:15 AM on the time display 13 of the FIG. 1 illustration), this causes one or more of the shofar call sounds represented within shofar sound medium 15 to be played through speaker 12. Hidden line 16 represents the connection, using any means known or that may become known in the art, which enables the shofar call sounds represented within shofar sound medium 15 to reach and be played through speaker 12.

Shofar alarm clock 1 also comprises user controls 18. These controls of course contain standard alarm clock elements such as would be required for the use to set the time at which the alarm is to be sounded. But, as described below, user controls 18 also enable the user to determine which shofar calls are to be sounded, as well as the sequence in which the calls are to be sounded. Optionally, the user can even specify different calls or call sequences at different times.

Shofar alarm clock 1 may also be embodied more in the nature of a grandfather clock or a chime clock or a cuckoo clock (referred to generally as a "periodic-sound clock") which activates audible sounds on the hour, or the half hour, or the quarter hour. The user controls can be used to specify which shofar calls are to be sounded, as well as the sequence in which the calls are to be sounded, at various time intervals. Alternatively, the patterns may be pre-established in the manufacture of the clock. Thus, for example, not limitation, Tekiah might be sounded on the quarter hour, Shevarim on the half hour, Teruah on the three-quarters hour, and Tekiah G'dollah on the hour.

Although the embodiment illustrated in FIG. 1 is that of an alarm clock, it is to be understood that other types of alarm are also envisioned and understood to fall within the scope of this disclosure and its associated claims. For example, a wristwatch or a cellular telephone, which contains a visual shofar replica including a drawing or print of a shofar, and which sounds a time-responsive alarm comprising shofar calls, is also regarded to be within the scope of this disclosure and its associated claims. Or, as noted above, this may be any type of chime/grandfather/cuckoo-type clock which makes certain tones on a regular basis to indicate, e.g., hours, half hours, and/or quarter hours.

While only certain preferred features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A shofar-sounding timekeeping apparatus (1), comprising:

a visual replica of a shofar (11), a shofar sound medium (15) comprising a representation of at least one shofar call sound (14); and a speaker (12) for audibly playing said at least one shofar call sound (14) represented within said shofar sound medium (15), in response to a timing device (17) of said timekeeping apparatus (1) reaching at least one predetermined time.

2. The apparatus of, said timekeeping apparatus (1) comprising an alarm clock.

3. The apparatus of, said timekeeping apparatus (1) comprising a periodic-sound clock.

4. The apparatus of, said visual replica of said shofar further comprising:

said speaker (12) proximate an output mouth thereof, for making said at least one audible shofar call therethrough.

5. The apparatus of, said shofar sound medium comprising a recording apparatus with said at least one audible shofar call recorded thereon.

6. The apparatus of, said shofar sound medium comprising a sound synthesizing apparatus synthesizing said at least one audible shofar call.

7. The apparatus of, said least one shofar call sound (14) comprising Tekiah.

8. The apparatus of, said least one shofar call sound (14) comprising Shevarim.

9. The apparatus of, said least one shofar call sound (14) comprising Teruah.

10. The apparatus of, said least one shofar call sound (14) comprising Tekiah G'dollah.

11. The apparatus of, said least one shofar call sound (14) comprising at least one sequence of Tekiah, Shevarim, Teruah, Tekiah.

12. The apparatus of, said least one shofar call sound (14) comprising at least one sequence of Tekiah, Shevarim, Tekiah.

13. The apparatus of, said least one shofar call sound (14) comprising at least one sequence of Tekiah Teruah, Tekiah.

14. The apparatus of, further comprising:

user controls (18) for enabling a user to set said at least one predetermined time.

15. The apparatus of, further comprising:

user controls (18) for enabling a user to determine which said shofar call sounds (14) are to be sounded in response to said timing device (17) reaching said at least one predetermined time.

16. The apparatus of, further comprising:

user controls (18) for enabling a user to determine a sequence in which said shofar call sounds (14) are to be sounded in response to said timing device (17) reaching said at least one predetermined time.

17. The apparatus of, wherein:

said at least one predetermined time is pre-established with the manufacture of said apparatus.

18. The apparatus of, wherein said at least one predetermined time comprises every hour on the hour.

19. The apparatus of, wherein said at least one predetermined time comprises every hour on the half hour.

20. The apparatus of, wherein said at least one predetermined time comprises every hour on the quarter and three-quarter hour.

21. The apparatus of, wherein at least two different shofar call sounds (14) are sounded at different predetermined times.

22. The apparatus of, wherein at least two different sequences of shofar call sounds (14) are sounded at different predetermined times.

23. A method of alerting a user to a time by shofar-sounding, comprising:

audibly playing through a speaker (12) of a timekeeping apparatus (1) comprising a visual replica of a shofar (11), at least one shofar call sound (14) in response to a timing device (17) of said timekeeping apparatus (1) reaching a predetermined time.

24. The method of, said timekeeping apparatus (1) comprising an alarm clock.

25. The method of, said timekeeping apparatus (1) comprising a periodic-sound clock.

26. The method of, further comprising:

making said at least one audible shofar call through said speaker (12) proximate an output mouth of said visual replica of said shofar.

27. The method of, further comprising audibly playing said at least one audible shofar call from a recording on a recording apparatus.

28. The method of, further comprising audibly playing said at least one audible shofar call from a sound synthesizing apparatus synthesizing said at least one audible shofar call.

29. The method of, said least one shofar call sound (14) comprising Tekiah.

30. The method of, said least one shofar call sound (14) comprising Shevarim.

31. The method of, said least one shofar call sound (14) comprising Teruah.

32. The method of, said least one shofar call sound (14) comprising Tekiah G'dollah.

33. The method of, said least one shofar call sound (14) comprising at least one sequence of Tekiah, Shevarim, Teruah, Tekiah.

34. The method of, said least one shofar call sound (14) comprising at least one sequence of Tekiah, Shevarim, Tekiah.

35. The method of, said least one shofar call sound (14) comprising at least one sequence of Tekiah Teruah, Tekiah.

36. The method of, further comprising:

a user setting said at least one predetermined time.

37. The method of, further comprising:

a user determining which said shofar call sounds (14) are to be sounded in response to said timing device (17) reaching said at least one predetermined time.

38. The method of, further comprising:

a user determining a sequence in which said shofar call sounds (14) are to be sounded in response to said timing device (17) reaching said at least one predetermined time.

39. The method of, further comprising:

pre-establishing said at least one predetermined time with the manufacture of said apparatus.

40. The method of, wherein said at least one predetermined time comprises every hour on the hour.

41. The method of, wherein said at least one predetermined time comprises every hour on the half hour.

42. The method of, wherein said at least one predetermined time comprises every hour on the quarter and three-quarter hour.

43. The method of, further comprising sounding at least two different shofar call sounds (14) at different predetermined times.

44. The method of, further comprising sounding at least two different sequences of shofar call sounds (14) at different predetermined times.

* * * * *